US005490081A

United States Patent [19]

Kuromoto et al.

[11] Patent Number: 5,490,081

[45] Date of Patent: Feb. 6, 1996

[54] WORKING TOOL OPERATION RANGE LIMITING APPARATUS

[75] Inventors: Kazunori Kuromoto; Takeshi Kobayashi; Koichi Kawamura, all of Osaka, Japan

[73] Assignee: Kabushiki Kaisha Komatsu Seisakusho, Tokyo, Japan

[21] Appl. No.: 182,131

[22] Filed: Jan. 14, 1994

[30] Foreign Application Priority Data

May 19, 1992 [JP] Japan ..... 4-150125

[51] Int. Cl.[6] ..... G06F 19/00

[52] U.S. Cl. ..... 364/474.2; 37/414; 212/280; 340/685; 364/424.07

[58] Field of Search ..... 364/474.2, 424.07, 364/461, 559, 174; 212/153, 154, 276–281; 340/685, 686; 37/234, 414–416

[56] References Cited

U.S. PATENT DOCUMENTS

| | | | |
|---|---|---|---|
| 5,198,800 | 3/1993 | Tozawa et al. | 364/424.07 |
| 5,335,176 | 8/1994 | Nakamura | 364/424.05 |
| 5,359,542 | 10/1994 | Pahmeier et al. | 364/424.07 X |

FOREIGN PATENT DOCUMENTS

| | | |
|---|---|---|
| 56-163330 | 12/1981 | Japan . |
| 3-156037 | 7/1991 | Japan . |
| 3-221628 | 9/1991 | Japan . |
| 3-208923 | 9/1991 | Japan . |

*Primary Examiner*—Joseph Ruggiero
*Attorney, Agent, or Firm*—Richards, Medlock & Andrews

[57] ABSTRACT

The velocity of a working tool of a hydraulic excavator can be automatically decelerated and stopped just before the working tool would encounter an obstacle. Hazard regions and decelerating regions which correspond upward, downward, forward, and other positions of the hydraulic excavator are designated and a working tool decelerating pattern $V_2$ where the working tool velocity decreases from 100% to 0% in a decelerating region is stored in a control unit. When a working tool velocity $V_1$ which corresponds to the amount of operations of working tool levers (1, 2) intersects with the working tool decelerating pattern $V_2$ in a decelerating region, the working tool moves at the velocity $V_2$ and stops just before a hazard region. A restoring pattern where the working tool is restored from a just-before-hazard position to a safety region is stored as a working tool accelerating pattern $V_4$ where the working tool velocity accelerates from a predetermined velocity just before a hazard region. This working tool accelerating pattern $V_4$ is stored in the control unit. The working unit velocity is accelerated along the working tool accelerating patter $V_4$. After the working tool accelerating pattern $V_4$ intersects with a working tool velocity $V_3$, which corresponds to the amount of operations of the working tool levers (1, 2), the working tool moves at the velocity $V_3$.

19 Claims, 5 Drawing Sheets

WORKING TOOL OPERATION RANGE LIMITING APPARATUS

TECHNICAL FIELD

The present invention relates to a working tool operation range limiting apparatus for use with a constructing machine such as a hydraulic excavator.

RELATED ART

A working tool for use with a hydraulic excavator comprises a boom, an arm, and a tool. One end of the boom is pivoted to an upper revolving subframe such that the boom is raised and lowered. The arm is pivoted to the other end of the boom. The tool is pivoted to the forward end of the arm. An example of the tool is a bucket. The working tool is operated by extending and contracting a boom cylinder, an arm cylinder, and a bucket cylinder. The upper revolving subframe is freely revolved over a main undercarriage. An operator's station is disposed on the upper revolving subframe. By manually operating two working tool levers disposed in the operator's station, the working tool is driven and the upper revolving subframe is revolved.

When a hydraulic excavator is operated for an excavating work, a loading work, or the like at an outdoor site, overhead electric cables may interfere with the operations of a working tool of the hydraulic excavator. On the other hand, when the hydraulic excavator is operated at an indoor site or an underground site, a ceiling or the like may interfere with the operations of the working tool of the hydraulic excavator, Although the operator of the hydraulic excavator carefully operates it so that the working tool is not in contact with such obstacles, an overhead cable may be cut or a building may be damaged due to his mistake. Thus, the operator may be injured or the hydraulic excavator may be damaged. As a countermeasure against such contact accidents, a working height limiting apparatus has been proposed in Japanese Patent Laid-Open Publication No. 3-208923. In this related art reference, a hazard region, a semi-hazard region, and a safety region have been set from the top to bottom of a hydraulic excavator. When the working tool is raised, if a member at the highest portion of the working tool reaches a boundary of the safety region and the semi-hazard region, the operation velocity of the working tool is decelerated. In addition, when this member reaches a boundary of the semi-hazard region and the hazard region, the operation of the working tool is stopped. Thus, when the working tool reaches the boundary of the safety region and the semi-hazard region, the working height limiting apparatus decelerates the operating velocity of the working tool. Consequently, the working tool is not shocked and a construction material carried by the working tool is not dropped.

However, as the stop operation of the working tool is performed only when the highest portion of the working tool reaches the boundary of the semi-hazard region and the hazard region, this portion will advance for a predetermined length until the working tool is stopped without a shock. Thus, when the hazard region is designated, the range of the hazard region should be increased for the distance that the highest portion is moved into the hazard region in the stop operation. In this case, the safety region, namely the working range, is reduced. Thus, the operation of the working tool becomes difficult. Moreover, in the case that the hazard region is reduced, when the working tool is stopped, a large shock may be applied to the working tool. Thus, the construction material may be dropped from the working tool or the operator may be dangerously shocked.

In addition, when a finish excavating operation is performed or when a construction material which is hung to the forward end of the working tool is aligned, the operator should precisely operate the working tool levers at a creep velocity. In this operation state, the working tool may be immediately stopped without applying a shock to the construction material. Thus, when the working tool velocity during the creep velocity operation by the operator is lower than the working tool velocity commanded by the working height limiting apparatus, the decelerating operation is not necessary even in the semi-hazard region.

Moreover, depending on a work site where a hydraulic excavator is used, hazard regions should be designated to upward, downward, and forward positions individually or in combinations thereof. Furthermore, in the case of an offset type hydraulic excavator which sidewardly excavates earth, hazard regions should be designated to sideward positions of the working tool, in particular, the operator's station so as to prevent the working tool from interfering with the hydraulic excavator in the offset state.

SUMMARY OF THE INVENTION

The present invention has been made so as to solve the above-mentioned problems.

An object of the present invention is to provide a working tool operation range limiting apparatus having a decelerating control unit which designates hazard regions to upward, downward, and forward positions, and if necessary sideward positions of an earth working vehicle and stops the working tool without a shock in such a way that any member of the working tool does not enter the hazard regions, and which does not operate while working tool levers are being operated at creep velocity.

The present invention is a working tool operation range limiting apparatus for use with an earth working machine which has a working tool, such as a bucket, and operation position detecting means, the working tool having a plurality of arms which are extendably and contractibly linked to each other, the working tool pivoted at the forward end of the arms, the apparatus comprising a control means for designating a plurality of hazard regions in an operation range space of the working tool, decelerating a working tool velocity as the working tool approaches each of the hazard regions, and stopping the working tool just before each of the hazard regions. In practicality, the control means of the present invention is a first control unit for designating at least one hazard region and a corresponding decelerating region to each of upward, downward, forward, and sideward positions of the earth working machine individually or in combinations thereof, decelerating a working tool velocity which corresponds to a predetermined decelerating pattern when a member of the working tool reaches a decelerating region, and stopping the working tool just before the member of the working tool reaches a hazard region. In addition, the present invention is a working tool operation range limiting apparatus further comprising a second control unit for comparing a first working tool velocity which corresponds to a predetermined decelerating pattern stored in the first control unit with a second working tool velocity which corresponds to the amount of operation of at least one manual working tool lever, and driving the working tool at the smaller one of the first working tool velocity and the second working tool velocity.

According to the present invention, the working tool can be stopped in a decelerating region rather than in a hazard region. In the decelerating region, since the working tool velocity is gradually decelerated, when the working tool is stopped, a shock applied thereto is very small. Since such a control unit is operated, contact accidents in each direction can be prevented. Moreover, it is not necessary to widen the hazard region in any direction for safety purpose.

In addition, while the operator is operating the operation levers at creep velocity and the working tool velocity which is proportional to the amount of the operations of the working tool levers is smaller than the working tool velocity corresponding to a predetermined decelerating pattern stored in the control unit, the control unit does not operate. Thus, in the decelerating region, the working tool velocity is not unexpectedly varied. Consequently, the working tool can be stably operated.

BEST MODE FOR CARRYING OUT THE INVENTION

Next, with reference to the accompanying drawings, an embodiment of a working tool operation range limiting apparatus according to the present invention is described.

Figure 1:
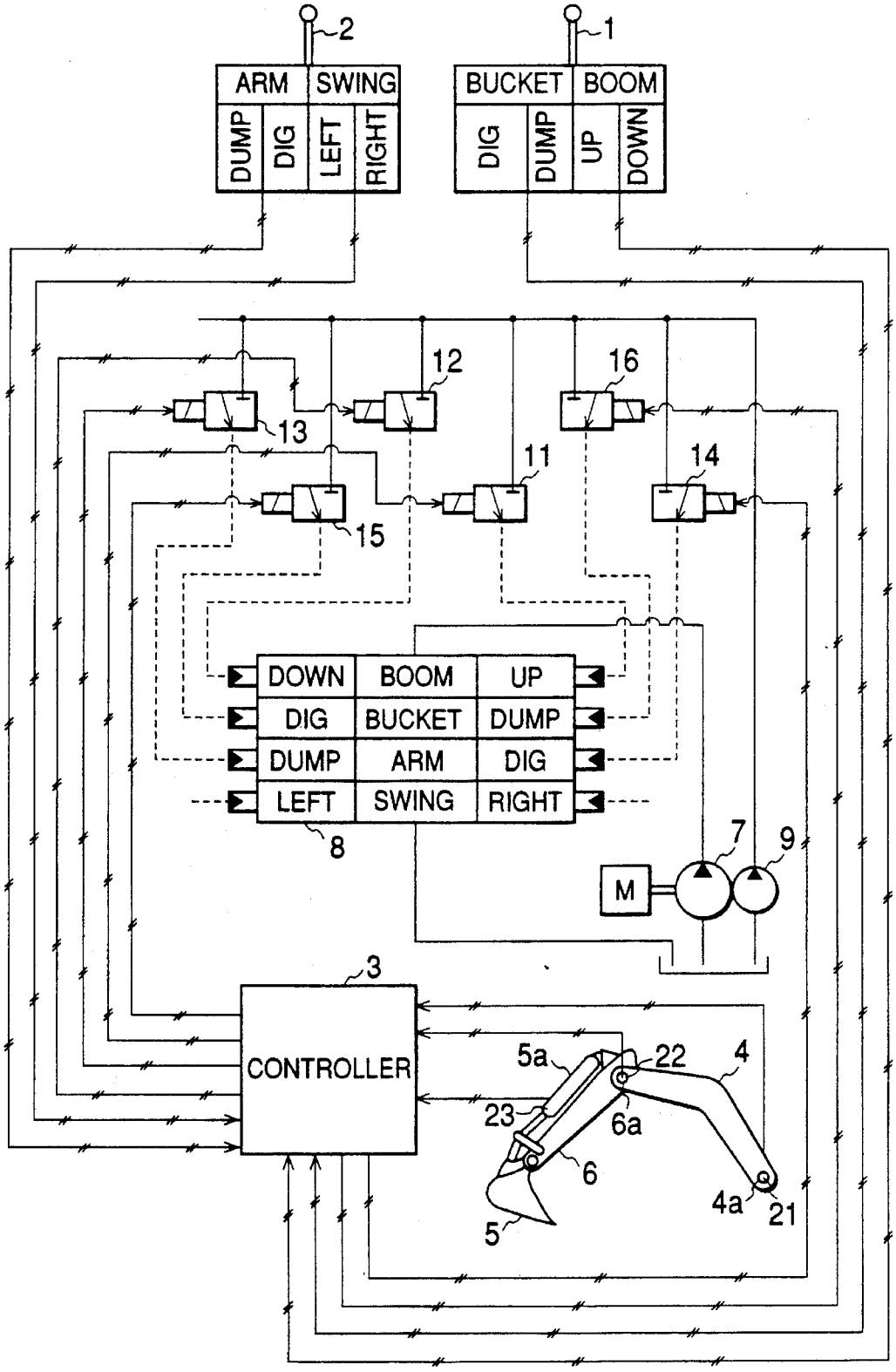
FIG. 1 is a hydraulic circuit and electric circuit showing a working tool operation circuit of a hydraulic excavator.

Referring to FIG. 1, two working tool levers 1 and 2 are disposed in the vicinity of an operator's station. Potentiometers are mounted on the working tool levers 1 and 2. Each of the potentiometers outputs to a controller 3 a signal voltage corresponding to the amount of operation of the corresponding working tool lever. With the working tool lever 1, a boom 4 is raised or lowered and a bucket 5 is placed in an excavating position or a dumping position. With the working tool lever 2, an arm 6 is moved to an excavating position or a dumping position and an upper revolving subframe is revolved in the left direction or the right direction. The boom 4, the arm 6, and the bucket 5 are driven by respective hydraulic cylinders. A directional control valve 8 is disposed in a hydraulic circuit which connects a main hydraulic pump 7 and each hydraulic cylinder. Solenoid proportional valves 11, 12, 13, 14, 15, and 16 are disposed in pilot hydraulic circuits which are connected from a pilot hydraulic pump 9 to respective ends of valve spools of the directional control valve 8. These solenoid proportional valves 11, 12, 13, 14, 15, and 16 are operated corresponding to the amount of command currents supplied from the controller 3. The boom 4 and the arm 6 have joint pins 4*a* and 6*a*, respectively. A boom angle sensor 21 and an arm angle sensor 22 are mounted on the joint pins 4*a* and 6*a*, respectively. The bucket 5 is driven by a bucket cylinder 5*a*. A bucket cylinder stroke sensor 23 is mounted on the bucket cylinder 5*a*. The output lines of these sensors are connected to the controller 3.

Figure 2:
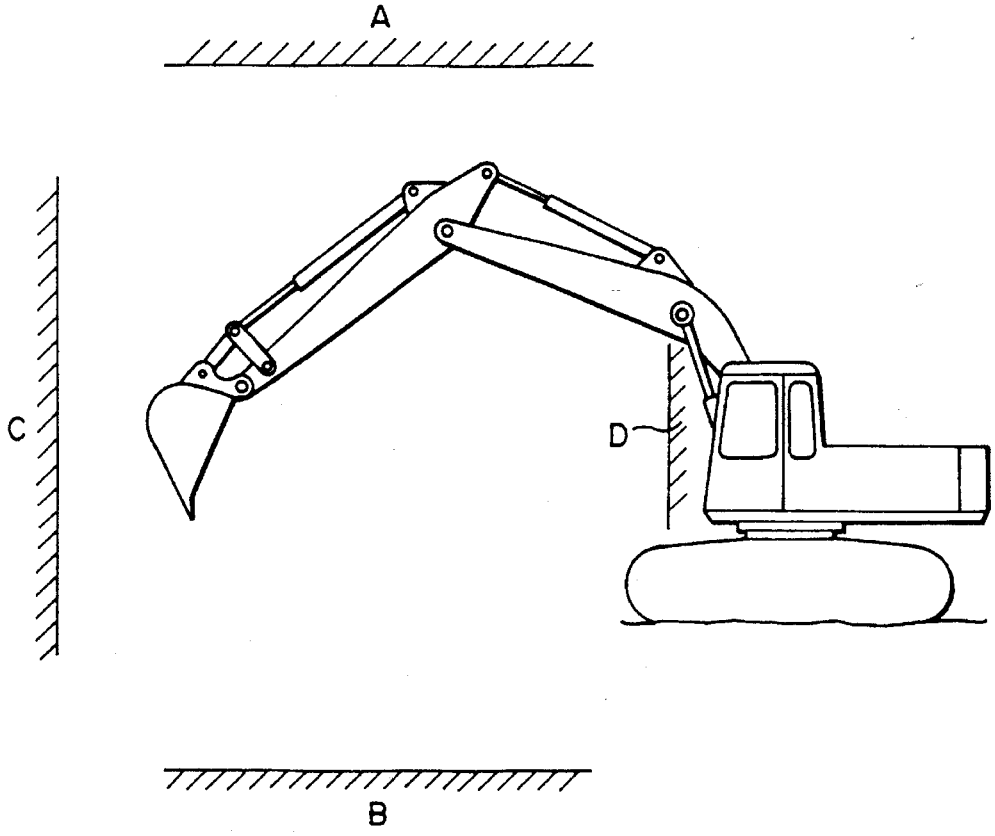
FIG. 2 is a schematic diagram for explaining hazard regions designated in each direction of the hydraulic excavator.

FIG. 2 is a schematic diagram for explaining hazard regions designated in an operation range space of the working tool of the hydraulic excavator. When setting a hazard region, the operator controls the working tool levers 1 and 2 so that a member of the working tool extends upwardly, downwardly, and/or forwardly from the hydraulic excavator. In the case of an offset type hydraulic excavator, the operator controls the working tool levers 1 and 2 so that a member of the working tool approaches the operator's station as much as possible in addition to upward, downward, and forward positions.

Figure 3:
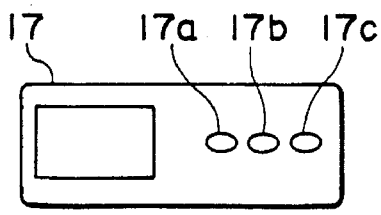
FIG. 3 is a plan view showing a monitor switch for designating hazard regions.

FIG. 3 is a plan view showing a monitor switch 17 for designating hazard regions at upward, downward, and forward positions. The monitor switch 17 is disposed in the vicinity of the operator's station. While the posture of the working tool is being kept, the operator presses a height set button 17*a*, a depth set button 17*b*, or a reach set button 17*c* corresponding to a hazard region to be designated. Thus, the designated hazard region, which is a hazard region A, B, or C shown in FIG. 2, is set according to the boom angle, arm angle, and the bucket angle at this point. In addition, the distance from the hazard region (A, B, or C) to the hydraulic excavator is set as a decelerating region. The space defined by the decelerating region and the hydraulic excavator is a safety region where the operator can operate the working tool at a desired velocity.

In the case of a hydraulic excavator with an offset function, a hazard region D can also be designated to sideward positions in addition to the upward, downward, and forward positions so as to prevent the working tool from interfering with the operator's station. In this case, one button for the hazard region D is added to the monitor switch 17. A decelerating region is designated in the direction where the working tool goes away from the hydraulic excavator.

Figure 4:
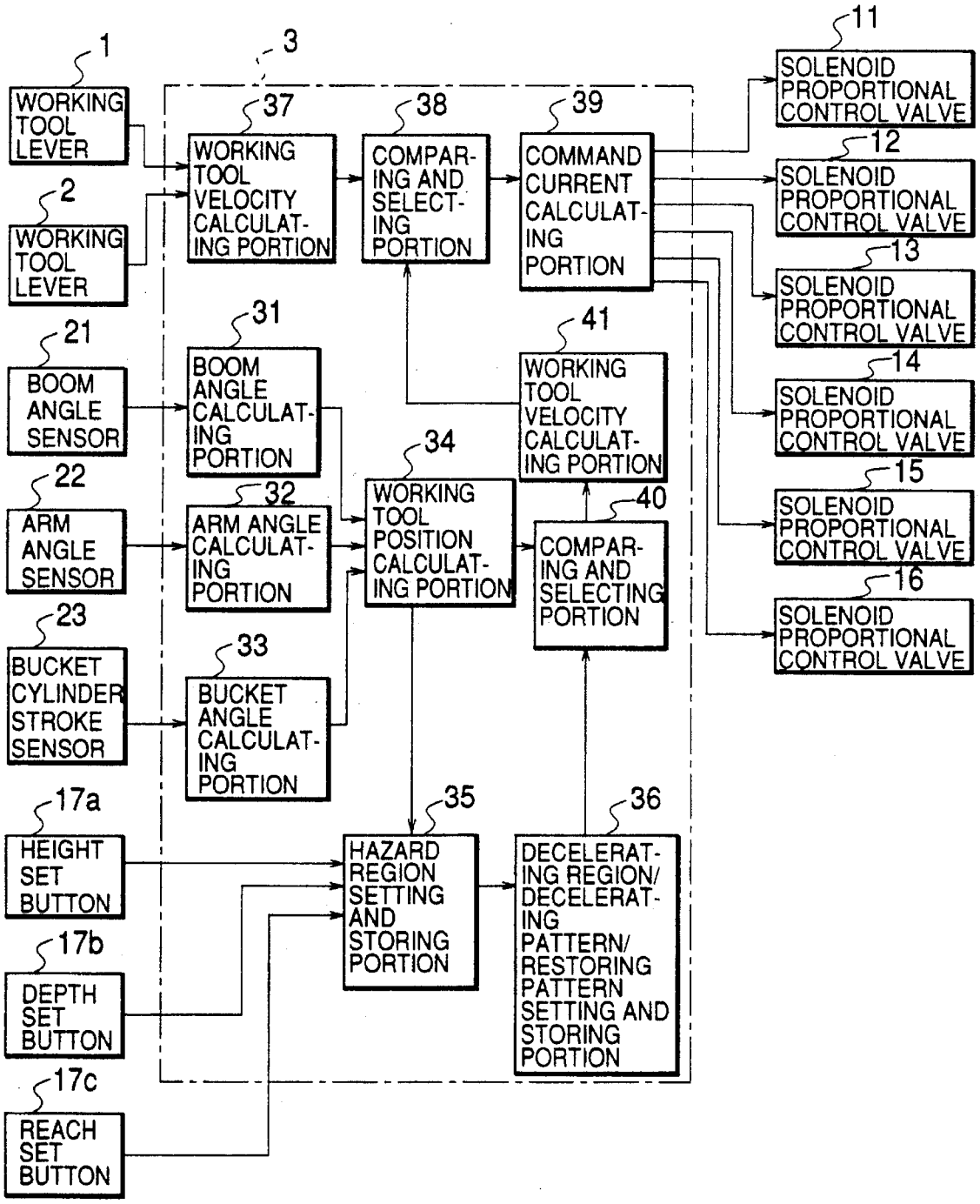
FIG. 4 is a block diagram showing a controller for controlling a working tool operation range limiting apparatus according to the present invention.

FIG. 4 is a block diagram showing a construction of the controller 3. As described above, when designating a hazard region, the operator controls the working tool levers 1 and so as to move the working tool to a desired position. Output signals of the boom angle sensor 21, the arm angle sensor 22, and the bucket cylinder stroke sensor 23 are sent to a boom angle calculating portion 31, an arm angle calculating portion 32, and a bucket angle calculating portion 33, respectively. The boom angle calculating portion 31, the arm angle calculating portion 32, and the bucket angle calculating portion 33 calculate respective angles. The calculated angles are sent to a working tool position calculating portion 34. The working tool position calculating portion 34 inputs these calculated angles and outputs a particular value. When the operator turns on one of the height set button 17*a*, the depth set button 17*b*, and the reach set button 17*c* of the monitor switch 17, the calculated value is sent to a hazard region setting and storing portion 35. After this value is stored in the hazard region setting and storing portion 35, it is also sent to a decelerating region/decelerating pattern/restoring pattern setting and storing portion 36. The decelerating region/decelerating pattern/restoring pattern setting and storing portion 36 sets and stores a working tool position/decelerating pattern and a restoring pattern. The working tool position/decelerating pattern is equivalent to a boundary of a safety region and a decelerating region. The restoring pattern is used to restore the working tool from a decelerating region to a safety region.

While the working tool levers 1 and 2 are being operated, signals, which are outputted from potentiometers, corresponding to the amount of the operations of the working tool levers 1 and 2, are sent to a working tool velocity calculating portion 37. The working tool velocity calculating portion 37 calculates a working tool velocity (for example, $V_1$). The working tool velocity $V_1$ is sent to a command current calculating portion 39 through a comparing and selecting portion 38. The command current calculating portion 39 calculates a command current value which is proportional to the working tool velocity $V_1$. The command current value is a current which energizes the solenoid proportional valve 11, 12, 13, 14, 15, or 16 disposed in the respective pilot hydraulic circuit connected from the pilot hydraulic pump 9 to the directional control valve 8. In the safety region, the command current value is sent to the solenoid proportional valve 11, 12, 13, 14, 15, or 16 through the comparing and selecting portion 38 so as to operate the directional control valve 8. In other words, the working tool is driven at a velocity proportional to the amount of operations of the working tool levers 1 and 2.

The working tool position calculating portion 34 always calculates the position of the working tool and sends the calculated value to the comparing and selecting portion 40. The comparing and selecting portion 40 compares the value received from the working tool position calculating portion 34 with the signal received from the decelerating region/decelerating pattern/restoring pattern setting and storing portion 36. The comparing and selecting portion 40 determines whether a member of the working tool reaches a boundary of a safety region and a decelerating region. When so determined, the working tool velocity calculating portion 41 calculates a working tool velocity (for example, $V_2$) in accordance with a decelerating pattern corresponding to the output signal of the decelerating region/decelerating pattern/restoring pattern setting and storing portion 36. The calculated result is sent to the comparing and selecting portion 38. The comparing and selecting portion 38 compares the working tool velocity $V_1$ with the working tool velocity $V_2$ and selects the smaller one of them. The selected working tool velocity is sent to the command current calculating portion 39. The command current calculating portion 39 calculates a command current value corresponding to the working tool velocity being selected. The calculated command current value, which is an exciting current, is sent to the solenoid proportional valve 11, 12, 13, 14, 15, or 16. When the working tool is restored from a decelerating region to a safety region, the decelerating region/decelerating pattern/restoring pattern setting and storing portion 36 outputs a working tool velocity corresponding to a restoring pattern.

Figure 5A:
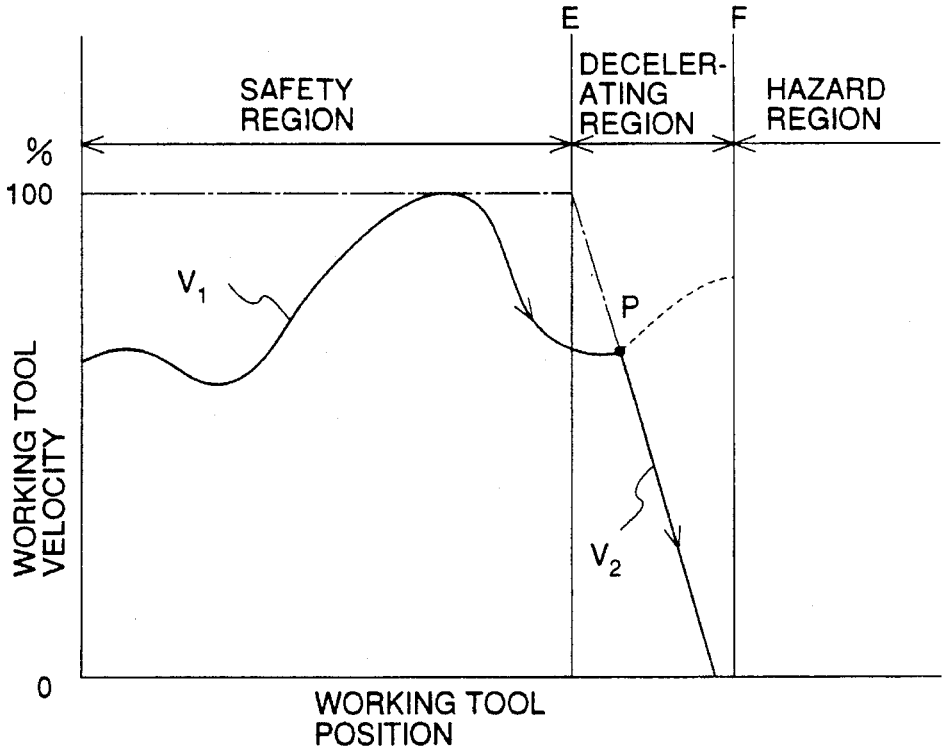
FIG. 5A is a graph showing a decelerating pattern of a working tool velocity at which the working tool approaches a hazard region.
Figure 5B:
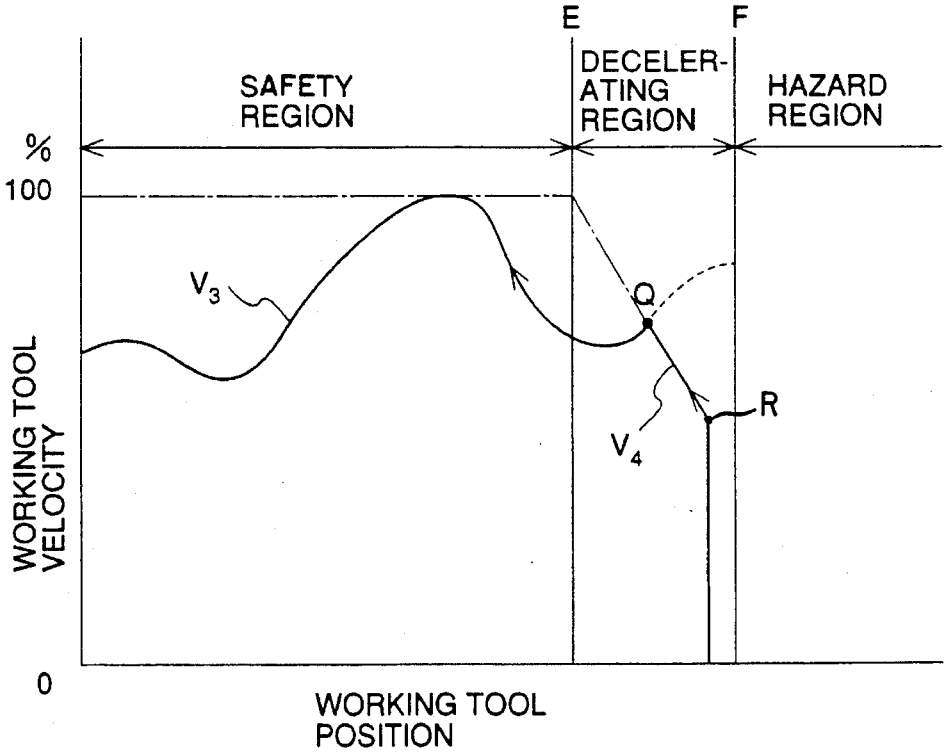
FIG. 5B is a graph showing a restoring pattern of a working tool velocity at which the working tool goes away from a hazard region.

FIG. 5A is a graph showing a decelerating pattern of a working tool velocity at which the working tool approaches a hazard region according to the working tool operation range limiting apparatus, and FIG. 5B is a graph showing a restoring pattern of a working tool velocity at which the working tool goes away from the hazard region. In these drawings, working tool velocity is shown with a ratio of 0 to 100% on the vertical axis, whereas the position of a member of the working tool which most closely approaches a hazard region is shown on the horizontal axis. In these drawings, reference symbol E represents a boundary of a safety region and a decelerating region; and reference symbol F represents a boundary of a decelerating region and a hazard region. With the operations of the working tool levers 1 and 2, as shown in FIG. 5A, the working tool velocity $V_1$ fluctuationally enters from a safety region to a decelerating region. On the other hand, a decelerating pattern which has been set and stored in the controller 3 is denoted by a line $V_2$ where a working tool velocity gradually decreases from 100% at the boundary E of the safety region and the decelerating region to 0% just before the boundary F of the decelerating region and the hazard region. When the velocity $V_1$ intersects with the velocity $V_2$ at point P, the working tool velocity decreases along the line $V_2$ and stops just before the hazard region regardless of the amount of operations of the working tool levers 1 and 2. In other words, when a member of the working tool enters a decelerating region, the controller 3 compares the working tool velocity $V_1$ which corresponds to the amount of operations of the working tool levers 1 and 2 with the working tool velocity $V_2$ which corresponds to a decelerating pattern and selects the smaller one of them. Thus, even if a member of the working tool has entered a decelerating region, before the velocity $V_1$ intersects with the velocity $V_2$, the working tool velocity does not decelerate at the velocity $V_2$ which corresponds to a decelerating pattern.

In FIG. 5B, a restoring pattern which has been set and stored in the controller 3 is denoted by a line $V_4$ where a working tool velocity increases from 0% to a predetermined value R just before the boundary F of the hazard region and the decelerating region. Thereafter, the working tool velocity is accelerated along the line $V_4$, which increases to 100% at the boundary E of the decelerating region and the safety region, until it intersects at point Q with a working tool velocity $V_3$ which corresponds to the amount of operations of the working tool levers 1 and 2. Thereafter, the working tool velocity becomes the velocity $V_3$. Thus, after the working tool has been stopped just before reaching the hazard region, the working tool can be restored to a safety region more quickly than its approach to the hazard region.

As described above, the controller 3 of the working tool operation range limiting apparatus selects the smaller one of the working tool velocity $V_2$, which corresponds to a decelerating pattern and has been set and stored, and the working tool velocity $V_1$, which corresponds to the amount of operations of the working tool levers 1 and 2, and outputs a control current to the solenoid proportional valve 8. When the operator returns the working tool levers 1 and 2 back to their neutral positions just before a member of the working tool enters a hazard region, the working tool is stopped. In other words, when the working tool velocity operated by the operator is lower than the velocity of a decelerating pattern, the operations of the working tool levers 1 and 2 have a higher precedence than the decelerating pattern.

Figure 6:
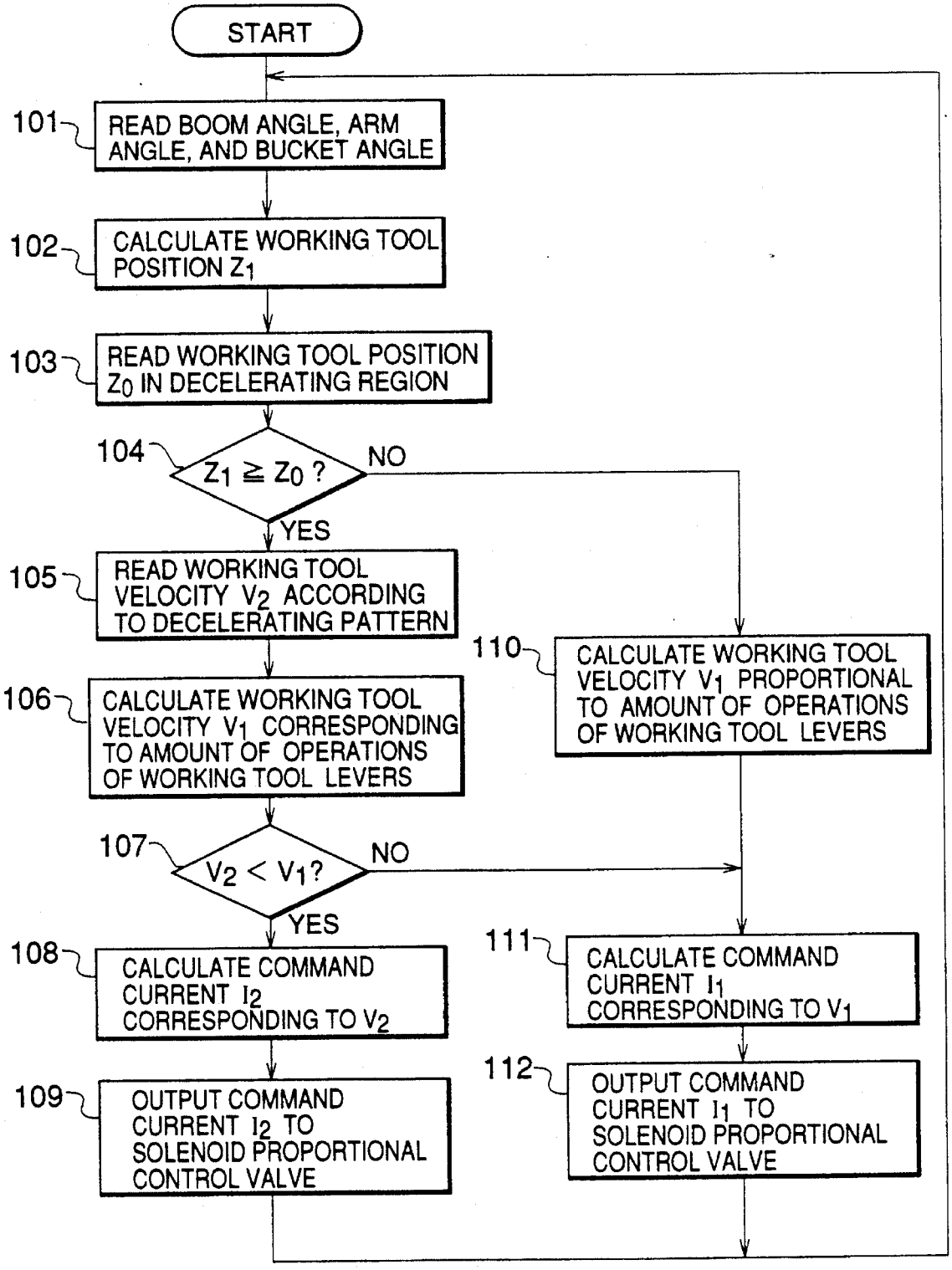
FIG. 6 is a flow chart for a decelerating control process which is executed when the working tool approaches a hazard region.

FIG. 6 is a flow chart showing a decelerating control process which is performed when the working tool approaches a hazard region. Reference numerals on the left of each step description represent step numbers. At step 101, a boom angle, an arm angle, and a bucket angle are read. At step 102, a representative value $Z_1$ of the position of the working tool is calculated. At step 103, the position of the working tool in a decelerating region (namely, a representative value $Z_0$ of the position of the working tool at a boundary of a safety region and a decelerating region) is read. At step 104, the representative value $Z_1$ is compared with the representative value $Z_0$. When $Z_1$ is equal to or larger than $Z_0$, it is determined that a member of the working tool has entered a decelerating region. Thus, at step 105, a working tool velocity $V_2$ which corresponds to the decelerating pattern is read. At step 106, a working tool velocity $V_1$ which corresponds to the amount of operations of the working tool levers 1 and 2 is calculated. At step 107, the working tool velocity $V_1$ is compared with the working tool velocity $V_2$. When $V_2$ is smaller than $V_1$, a command current 12 which is equivalent to $V_2$ is calculated. At step 109, the command current $I_2$ is sent to a solenoid proportional valve.

At step 104, when $Z_1$ is smaller than $Z_0$, since any member of the working tool has not reached a decelerating region, the flow advances to step 110. At step 110, a working tool velocity which corresponds to the amount of operations of the working tool levers 1 and 2 is calculated. At step 111, a command current $I_1$, which is equivalent to the velocity $V_1$ is calculated. At step 112, the command current $I_1$ is sent to a solenoid proportional valve 8. At step 107, when it is determined that $V_2$ is larger than $V_1$, the flow advances to step 111. By repeating these steps of the flow chart, the position of each member of the working tool and the working tool velocity are controlled.

In the above-mentioned embodiment, a working tool operation range limiting apparatus incorporated into a hydraulic excavator was described. However, it should be appreciated that the present invention can be also applied to other types of earth working machines or industrial vehicles. In addition, in an offset type hydraulic excavator which can excavate sideward thereof, the working tool can be prevented from interfering with the hydraulic excavator main body, in particular, the operator's station. Moreover, in the above-mentioned embodiment, as a means for detecting an operation angle of a working tool (for example, a bucket), a bucket cylinder stroke sensor 23 was used. However, as with the boom 4 and the arm 6, the operation angle can be detected by an angle sensor. Furthermore, stroke sensors can be mounted on the boom cylinder, arm cylinder, and bucket cylinder so as to detect operation angles thereof.

INDUSTRIAL UTILIZATION

According to the working tool operation range limiting apparatus of the present invention, the operator can safely operate an earth working machine or an industrial vehicle in a restricted space without taking care of obstacles, thereby reducing his mental fatigue and improving working efficiency.

We claim:

1. A working tool operation range limiting apparatus for use with an earth working machine which has a working tool and an operation position detecting means, said working tool having a plurality of arms which are extendably and contractibly linked with each other, said working tool being pivoted at the forward end of said arms, said apparatus comprising:

a first control unit for designating at least one hazard region and a corresponding decelerating region to upward, downward, forward, and sideward positions of said earth working machine individually or in combinations thereof, for decelerating a working tool velocity which corresponds to a predetermined decelerating pattern when a member of said working tool reaches said decelerating region, and for stopping said working tool just before the member of said working tool reaches said hazard region; and a second control unit for comparing a first working tool velocity which corresponds to a predetermined decelerating pattern stored in said first control unit with a second working tool velocity which corresponds to the amount of operation of at least one manual working tool lever and for driving said working tool at the smaller one of said first working tool velocity and said second working tool velocity.

2. A working tool operation range limiting apparatus for use with a machine having a movable working arm, a working tool pivotally attached to one end of the working arm, said apparatus comprising:

first means for designating at least one hazard region in an operation range space of the working tool; and second means for decelerating the velocity of the working tool as the working tool approaches each of the at least one hazard region and for stopping movement of the working tool toward the respective hazard region just before the working tool would otherwise enter the respective hazard region;

wherein said first means comprises means for designating a hazard region and a corresponding decelerating region for at least one of upward, downward, forward, and sideward positions of the working tool; and wherein said second means comprises means for providing a predetermined decelerating pattern, means for determining a selected velocity of the working tool, means for comparing the thus determined selected velocity of the working tool with the predetermined decelerating pattern, and means for decelerating the working tool velocity when the working tool enters a decelerating region and the thus determined selected velocity is greater than a corresponding portion of the predetermined decelerating pattern.

3. A working tool operation range limiting apparatus in accordance with claim 2, wherein said means for determining a selected velocity of the working tool comprises an operation lever and an operation lever position detecting means for indicating the selected velocity of the working tool as a function of the position of the operation lever.

4. A working tool operation range limiting apparatus in accordance with claim, wherein said second means further comprises means for providing a predetermined restoring pattern of a working tool velocity for moving the working tool away from the respective hazard region, means for comparing a selected velocity of the working tool away from the respective hazard region with the predetermined restoring pattern, and means for driving the working tool away from the respective hazard region in accordance with the smaller of the selected velocity of the working tool away from the respective hazard region and a corresponding portion of the predetermined restoring pattern.

5. A working tool operation range limiting apparatus in accordance with claim 4, wherein said first means further comprises means for storing values representing each thus designated hazard region and each thus designated corresponding decelerating region and for storing the predetermined decelerating pattern and the predetermined restoring pattern.

6. A working tool operation range limiting apparatus in accordance with claim 5, wherein said means for decelerating the working tool velocity when the working tool enters a decelerating region comprises means for driving the working tool at the smaller one of a selected velocity of the working tool toward the respective hazard region and the corresponding portion of the predetermined decelerating pattern.

7. A working tool operation range limiting apparatus for use with a machine having a movable working arm, a working tool pivotally attached to one end of the working arm, said apparatus comprising:

first means for designating at least one hazard region in an operation range space of the working tool; and second means for decelerating the velocity of the working tool as the working tool approaches each of the at least one hazard region and for stopping movement of the working tool toward the respective hazard region just before the working tool would otherwise enter the respective hazard region;

wherein said second means comprises means for providing a predetermined decelerating pattern, means for determining the velocity of the working tool, means for comparing the thus determined velocity of the working tool with the predetermined decelerating pattern, and means for decelerating the working tool velocity when the working tool enters a decelerating region and the working tool velocity is greater than a corresponding portion of the predetermined decelerating pattern.

8. A working tool operation range limiting apparatus in accordance with claim 7, wherein said first means comprises means for driving the working tool at the smaller one of a selected velocity of the working tool toward the respective hazard region and the corresponding portion of the predetermined decelerating pattern.

9. A method of limiting the operation range of a working tool on a machine having a movable working arm and the working tool pivotally attached to one end of the working arm, said method comprising the steps of:

designating at least one hazard region in an operation range space of the working tool, operating the working tool at a velocity, controlling the velocity of the working tool to decelerate the velocity of the working tool whenever the working tool approaches any one of said at least one hazard region, and stopping the movement of the working tool toward the respective hazard region just before the working tool would otherwise enter the respective hazard region;

wherein the step of designating at least one hazard region comprises designating a hazard region and a corresponding decelerating region for at least one of upward, downward, forward, and sideward positions of the working tool, and storing values representing each thus designated hazard region and each thus designated corresponding decelerating region;

wherein the step of controlling comprises providing a predetermined decelerating pattern, determining a selected velocity of the working tool toward a respective hazard region, comparing the thus determined selected velocity of the working tool with the predetermined decelerating pattern, and decelerating the working tool velocity when the working tool enters a decelerating region and the selected velocity of the working tool is greater than a corresponding portion of the predetermined decelerating pattern.

10. A method in accordance with claim 9, wherein the step of controlling further comprises driving the working tool at the smaller one of the thus determined selected velocity of the working tool toward the respective hazard region and the corresponding portion of the predetermined decelerating pattern.

11. A method in accordance with claim 10, wherein the step of controlling further comprises operating an operation lever to indicate the desired operation of the working tool, and establishing the selected velocity of the working tool as a function of the position of the operation lever.

12. A method in accordance with claim 11, wherein the step of controlling further comprises providing a predetermined restoring pattern of a working tool velocity for moving the working tool away from the respective hazard region, determining a selected velocity of the working tool away from the respective hazard region, and driving the working tool away from the respective hazard region in accordance with the smaller of the selected velocity of the working tool away from the respective hazard region and a corresponding portion of the predetermined restoring pattern.

13. A working tool operation range limiting apparatus in accordance with claim 7, wherein said means for determining the velocity of the working tool comprises an operation lever and an operation lever position detecting means for indicating the velocity of the working tool as a function of the position of the operation lever.

14. A working tool operation range limiting apparatus in accordance with claim 13, wherein said second means further comprises means for providing a predetermined restoring pattern of a working tool velocity for moving the working tool away from the respective hazard region, means for comparing a velocity of the working tool away from the respective hazard region with the predetermined restoring pattern, and means for driving the working tool away from the respective hazard region in accordance with the smaller of the velocity of the working tool away from the respective hazard region and a corresponding portion of the predetermined restoring pattern.

15. A working tool operation range limiting apparatus for use with a machine having a movable working arm, a working tool pivotally attached to one end of the working arm, said apparatus comprising:

first means for designating at least one hazard region in an operation range space of the working tool; and second means for decelerating the velocity of the working tool as the working tool approaches each of the at least one hazard region, and for stopping movement of the working tool toward the respective hazard region just before the working tool would otherwise enter the respective hazard region;

wherein said second means comprises means for providing a predetermined restoring pattern of a working tool velocity for moving the working tool away from the respective hazard region, means for comparing a velocity of the working tool away from the respective hazard region with the predetermined restoring pattern, and means for driving the working tool away from the respective hazard region in accordance with the smaller of the velocity of the working tool away from the respective hazard region and a corresponding portion of the predetermined restoring pattern.

16. A working tool operation range limiting apparatus in accordance with claim 15, wherein said first means further comprises means for storing values representing each thus designated hazard region and each thus designated corresponding decelerating region and for storing a predetermined decelerating pattern and the predetermined restoring pattern, and wherein said second means comprises means for driving the working tool at the smaller one of a velocity of the working tool toward the respective hazard region and a corresponding portion of the predetermined decelerating pattern.

17. A working tool operation range limiting apparatus in accordance with claim 2, wherein said means for decelerating the working tool velocity comprises means for driving the working tool at the smaller one of a velocity of the working tool toward the respective hazard region and a corresponding portion of a predetermined decelerating pattern.

18. A method in accordance with claim 9, wherein the step of controlling comprises providing a predetermined decelerating pattern, determining a selected velocity of the working tool toward a respective hazard region, comparing the thus determined selected velocity of the working tool with the predetermined decelerating pattern, and driving the working tool at the smaller one of the thus determined selected velocity of the working tool toward the respective hazard region and a corresponding portion of the predetermined decelerating pattern.

19. A method in accordance with claim 9, further comprising providing a predetermined restoring pattern of a working tool velocity for moving the working tool away from the respective hazard region, determining a selected velocity of the working tool away from the respective hazard region, and driving the working tool away from the respective hazard region in accordance with the smaller of the selected velocity of the working tool away from the respective hazard region and a corresponding portion of the predetermined restoring pattern.

* * * * *

UNITED STATES PATENT AND TRADEMARK OFFICE

CERTIFICATE OF CORRECTION

PATENT NO. : 5,490,081

DATED : February 6, 1996

INVENTOR(S) : Kazunori KUROMOTO et al

It is certified that error appears in the above-identified patent and that said Letters Patent is hereby corrected as shown below:

Title page, Item [22], delete "Filed: Jan. 14, 1994" and insert

-- PCT Filed: May 19, 1993
[86] PCT No.: PCT/JP93/00655
§ 371 Date: Jan. 14, 1994
§ 102(e) Date: Jan. 14, 1994
[87] PCT Pub. No.: WO 93/23628
PCT Pub. Date: Nov. 25, 1993--.

Column 8, line 36, delete "claim," and insert --claim 3,--.

Column 9, line 3, delete "region" and insert --region,--.

Signed and Sealed this

Third Day of December, 1996

Bruce Lehman

*Attest:*

BRUCE LEHMAN

*Attesting Officer*

*Commissioner of Patents and Trademarks*